US011088461B1

(12) United States Patent
Lee-Yow et al.

(10) Patent No.: US 11,088,461 B1
(45) Date of Patent: Aug. 10, 2021

(54) QUAD BAND PETAL REFLECTOR ANTENNA

(71) Applicant: Custom Microwave Inc., Longmont, CO (US)

(72) Inventors: Clency Lee-Yow, Niwot, CO (US); Sudhakar K. Rao, Rancho PalosVerdes, CA (US); Suzanna Janet LaMar, San Diego, CA (US); Philip Elwood Venezia, Longmont, CO (US)

(73) Assignee: CUSTOM MICROWAVE INC., Longmont, CO (US)

( * ) Notice: Subject to any disclaimer, the term of this patent is extended or adjusted under 35 U.S.C. 154(b) by 0 days.

(21) Appl. No.: 17/208,301

(22) Filed: Mar. 22, 2021

Related U.S. Application Data

(60) Provisional application No. 63/090,648, filed on Oct. 12, 2020.

(51) Int. Cl.
*H01Q 15/16* (2006.01)
*H01Q 1/12* (2006.01)
*H01Q 1/28* (2006.01)

(52) U.S. Cl.
CPC ..... *H01Q 15/162* (2013.01); *H01Q 1/1235* (2013.01); *H01Q 1/288* (2013.01)

(58) Field of Classification Search
CPC .... H01Q 15/161; H01Q 15/162; H01Q 15/16; H01Q 15/165; H01Q 15/168; H01Q 15/141; H01Q 1/288; H01Q 1/1235
See application file for complete search history.

(56) References Cited

U.S. PATENT DOCUMENTS

| | | | | |
|---|---|---|---|---|
| 10,199,734 | B2 * | 2/2019 | Eom | H01Q 19/132 |
| 2009/0243955 | A1 * | 10/2009 | Legare | H01Q 1/08 343/882 |
| 2014/0015735 | A1 * | 1/2014 | Lebrun | H01Q 15/165 343/912 |
| 2014/0152492 | A1 * | 6/2014 | Zimmerman | H01Q 1/08 342/352 |
| 2018/0191078 | A1 * | 7/2018 | Moore | H01Q 21/30 |

* cited by examiner

*Primary Examiner* — Awat M Salih

(57) ABSTRACT

The present invention provides a petal reflector antenna that comprises a main reflector having a paraboloid shape and a plurality of identical petals, a feed assembly that includes a horn, a wideband junction, a holder, and a hybrid coupler connected to a diplexer and a multiplexer. The petal reflector antenna further comprises a protective radome cover, a horn, a subreflector, and a support station member for quickly and conveniently set up over a desired ground location. The petal reflector antenna can operate simultaneously in the K, Ka, Ku receive, and Ku transmit frequency bands.

16 Claims, 16 Drawing Sheets

| ITEM | Phased Array (PA) | Reflector (R) |
|---|---|---|
| Design | Two 40 X 40 K/KaPAs<br>Two 10X10 Ku Tx/Rx PAs | One 15" Reflector with 6 petals |
| Size | 18" X 8.4" X 2.0" | 15" dia X 5.0" long |
| Mass | 60 lbs | 10.5 lbs |
| Power | 90 W*Hr | 22 W*Hr |
| Gain | Medium | High |
| Cost | High | Low |
| Schedule | Long | Short |

FIG. 9

| Reflector Type: 15" Dia ADE F/D 0.25 | | | | |
|---|---|---|---|---|
| Frequency, GHz | 14.4 | 15.15 | 20.2 | 30 |
| Peak Directivity | 31.5 | 32.5 | 35.2 | 38.8 |
| | | | | |
| | | | | |
| Antenna Loss Budget | | | | |
| Cross Pol Impact (1.5 dB AR) | -0.028 | -0.028 | -0.028 | -0.028 |
| Struts | -0.23 | -0.23 | -0.25 | -0.25 |
| Alignment error | -0.02 | -0.02 | -0.02 | -0.02 |
| Reflector System Losses | -0.28 | -0.28 | -0.30 | -0.30 |
| | | | | |
| Horn | -0.20 | -0.20 | -0.20 | -0.20 |
| Hybrid (with cables 6") | -0.88 | -0.88 | -1.31 | -1.56 |
| Cable Loss 2Ft | -1.12 | -1.12 | -1.22 | -1.44 |
| QuadPlexer | -1.90 | -1.90 | -1.50 | -1.50 |
| Radome Loss | -0.05 | -0.05 | -0.05 | -0.05 |
| Mismatch Loss for the feed (> 14 dB) | -0.17 | -0.17 | -0.17 | -0.17 |
| Feed System Losses | -4.32 | -4.32 | -4.45 | -4.92 |
| Antenna Assembly Losses at ambient | -4.60 | -4.60 | -4.75 | -5.22 |
| | | | | |
| Main Reflector Surface error (.003" RMS) | -0.009 | -0.009 | -0.028 | -0.039 |
| Sub reflector Surface error (.001" RMS) | -0.001 | -0.001 | -0.003 | -0.003 |
| Feed Loss at 40 C | -0.15 | -0.15 | -0.15 | -0.15 |
| Main Reflector loss due to thermal distortion (TBC) | -0.027 | -0.027 | -0.084 | -0.117 |
| Impact from Random Errors (RSS) | -0.15 | -0.15 | -0.17 | -0.19 |
| | | | | |
| Total Antenna Loss, dB | -4.75 | -4.75 | -4.92 | -5.41 |
| Expected Antenna Peak Gain, dB | 26.75 | 27.75 | 30.28 | 33.39 |

FIG. 14

QUAD BAND PETAL REFLECTOR ANTENNA

The current application claims a priority to the U.S. provisional patent application Ser. No. 63/090,648 filed on Oct. 12, 2020.

FIELD OF THE INVENTION

The present invention generally relates to an antenna for wireless communication. More specifically, the present invention relates to a single antenna with a quad-plexed feed that supports transmit and receive functions on four different frequency bands.

BACKGROUND OF THE INVENTION

An antenna designed to meet the operational requirements of soldiers on the ground is in demand. Communication systems in commerce as well as military communication systems, which involve signals in all aspects of communications, or conveyance of information by armed forces, have evolved from single-band systems to multiband systems with a view to improving coverage, bandwidth, data throughput, and connectivity via aircrafts and satellites. Size, mass, cost and power are the key factors for these antennas for ease of transportability in the battle field.

The Defense Satellite Communications System (DSCS) systems, for example, use X-band (8 gigahertz [GHz]), whereas the Wideband Gapfiller Satellite (WGS) system developed for the U.S. Air Force uses X-band, K-band (20 GHz), and Ka-band (30 GHz) services. Future development of communication systems will require a variety of functionalities, such as improved connectivity, anti-jamming performance, small terminal user support, and increased data throughput. The antenna systems employ several apertures to meet different frequency bands, either phased arrays or reflector antennas.

The Defense Advanced Research Projects Agency (DARPA) is developing communications technologies through its Protected Forward Communications (PFC) Program that will enable small unit tactical operations to persist in a contested electromagnetic environment using an integrated communication system.

Various sources have indicated that future PFC will require lightweight portable antennas that provide high gain for communication with aircraft and satellites such as WGS, operating in the Ku-transmit, Ku-Receive, K, and Ka bands for uplink and downlink communications.

Various types of antennas are used in wireless communication. Phased arrays, which can change the shape and direction of a radiation pattern without requiring physical movement of the antennas, are developed for use in military radar systems and are now also widely used in civilian applications.

Phased arrays are a PFC candidate but have some drawbacks. They require four separate phased arrays with 1,600 elements each (40×40 arrays) for the K and Ka bands as well as 100 elements each for the Ku-transmit and Ku-receive bands. They also require a large number of amplifiers (qty. 3,400) and suffer from 6-8 dB of scan loss over a large scan area of ±80 degrees. What's more, they are heavy and expensive and are associated with increased power dissipation. Conventional antennas also present practical problems relating to shipping, handling, installation, assembly complexity, size, mass and cost. Thus, there is a need to develop a device that solves these problems.

The present invention is intended to address problems associated with and/or otherwise improve on conventional devices through an innovative antenna device that is designed to provide convenient, effective, and inexpensive installation while offering high levels of performance and incorporating other problem-solving features for field deployment.

SUMMARY

In accordance with the present invention, a novel antenna system is provided that requires a single antenna with a quad-plexed (separating and isolating four frequency bands) feed that supports transmit and receive functions at desired four different bands. The present invention employs a compact main reflector with a small ratio of focal length to antenna aperture size (f/d) and is equipped with an axially displaced ellipsoidal (ADE) subreflector. The main reflector is a paraboloid in shape or a shaped surface comprising multiple identical petals made of metal-plated plastic that is light-weight and that can be deployed/stowed easily and quickly in the field.

In one embodiment, the present invention includes a single antenna system that supports four different bands: Ku receive, Ku transmit, K receive, and Ka transmit. The antenna employs a novel feed system, supporting left-hand or right-hand circular polarizations at the K and Ka bands as well as right-hand circular polarization at the Ku band.

In another embodiment, the antenna employs a main reflector and a subreflector that are fed with a quad-band feed system, including a horn and a feed assembly that support multiple services.

The main reflector can be illuminated using the feed assembly, and the main reflector surface can be either parabolic or shaped in order to optimize gain performance over the desired frequency band(s). In one embodiment the main reflector produces congruent beams over the frequency bands.

The feed assembly comprises a horn that supports the desired bands. The horn (a quad-band feed horn) that supports the four different bands is coupled to the feed assembly, separating the four frequency bands with a high degree of isolation among them.

In one preferred embodiment, the antenna system has one or more of the following advantages over prior designs: a system that includes high gain through a single quadplexed antenna, use of a feed assembly, light weight, low cost, wide scan through two-axis commercial off-the-shelf (COTS) gimbal, and portability in the field. The present invention is designed to be mounted on a lightweight COTS gimbal with ±90-degree conical scan on a COTS tripod mount. This system has significant performance advantage of more than 6 dB since there is no scan loss associated with beam scanning unlike other systems such as phased arrays.

Using one antenna instead of four reduces cost, mass, and dissipation. Specifically, the present invention costs less than 20 times than conventional phased arrays do.

The present invention's lightweight structure, high level of performance, low cost, low mass, and ease of deployment in the field make it attractive for future PFC for soldiers on the ground, and several thousand such units will be required over the next few years. This antenna's significant advantages compared with conventional phased array antennas make it attractive for use in future ground and satellite systems.

BRIEF DESCRIPTION OF THE DRAWINGS

FIG. 9 is a diagram illustrating a comparison between the conventional PA antenna and the present invention.

FIG. 14 is a diagram illustrating a deployed antenna configuration and detailed gain/loss budgets of the present invention where losses from various components are given.

DETAIL DESCRIPTIONS OF THE INVENTION

All illustrations of the drawings are for the purpose of describing selected versions of the present invention and are not intended to limit the scope of the present invention.

The present invention's structural uniqueness comes from a main reflector (petal reflector) whose six identical petals can be readily removed and installed on the battlefield by a single soldier. Each is made of a plastic material (ensuring low cost and low mass) that is metalized. The feed assembly that supports the subreflector can also be removed for storage.

The present invention has many potential applications, including in satellite-based and ground-based systems. For satellite-based applications, either a petal design or a solid graphite main reflector can be used, depending on the satellite's environments and the size of the reflector.

The present invention can also be used with a plastic protective radome cover over the horn to protect the present invention from environmental damage.

Figure 1:
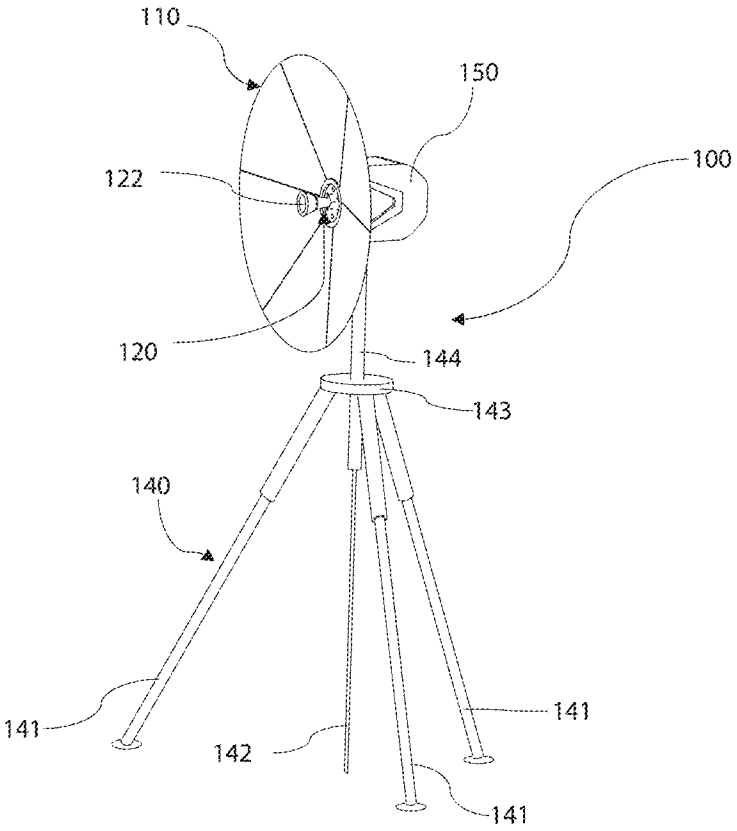
FIG. 1 is an illustration of one embodiment of the present invention.

As FIG. 1 shows, the present invention provides a petal reflector antenna system 100 that comprises a main reflector 110, a feed assembly 120, a subreflector 122, a support station member 140, and a gimbal 150 in accordance with a preferred embodiment of the present invention.

The subreflector 122 can be coupled to the feed assembly 120 that is secured to the main reflector 110 and the main reflector 110 can be attached to the support station member 140 so as to form the petal reflector antenna of the present invention.

Any types of fasteners may be used for securing various different components of the present invention together and various different kinds of struts known in the art may be used. Some components of the present invention may be attached together by brazing or welding or by other methods known to those skilled in the art. However, fasteners that can be easily detached without the use of tools should be used where necessary so that the present invention can be easily disassembled and assembled.

Figure 2:
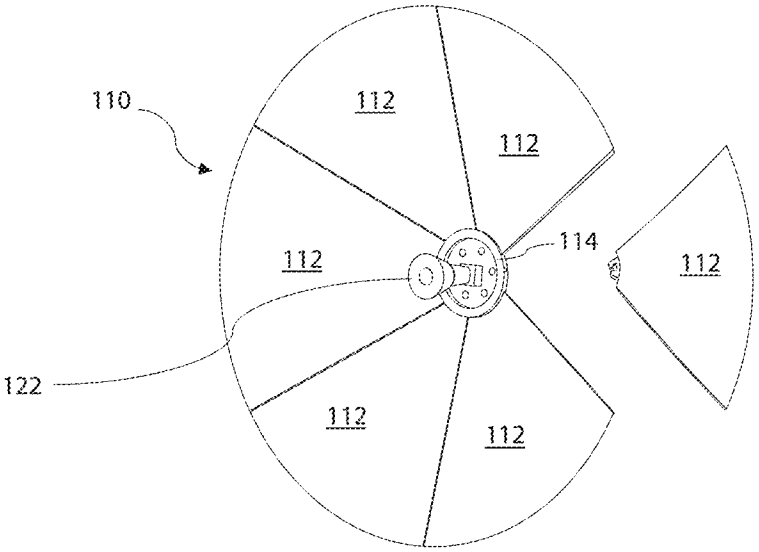
FIG. 2 is an illustration of one embodiment of main reflector of the present invention attached to the feed assembly and the subreflector.

FIG. 2 illustrates the main reflector 110 of paraboloidal shape that comprises a plurality of identical petals 112. In some embodiments, each petal 112, which can be substantially curved trapezoidal, may subtend an angle of 60 degrees at its central apex, curving outward so that its central section through its altitude defines substantially a parabola.

In some embodiments, the petals 112 can be attached to surrounding the base 114, which can feature a ring-shaped structure connected to the feed assembly. In such embodiments, the petals 112 can be assembled together and attached to the base 114 by means of a snap-fastening coupling common in the industry (e.g., quick-connect, snap, snap-on, or push-on coupling means known in the art). As defined herein, snap-fastening coupling means relate to the use of any complementary pair of coupling mechanisms that can be secured together using an axial, or linear, force.

Figure 3:
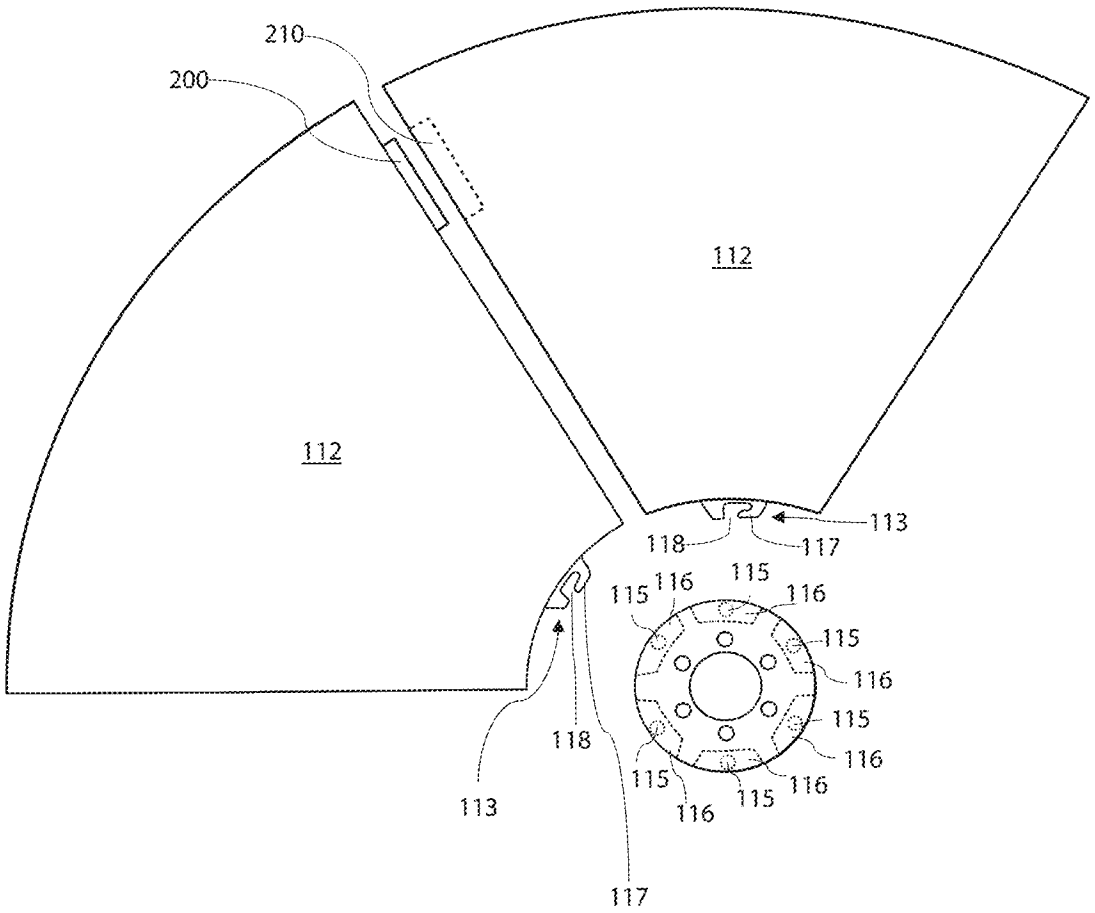
FIG. 3 is an illustration showing how the petals can be connected to the base of the present invention.

In one embodiment, the petals 112 can be attached to the base 114 by a rail hook 113, as shown in FIG. 3. The rail hook 113 can be mounted at an end of the petal 112, when assembled, and engages the post 115 mounted on the base 114. The post 115 may be a leg or a cylindrical rod. The rail hook 113 can be suitably sized to slide into a slot 116 in the base 114. The rail hook 113 may include a downwardly extending arm 117 forming an indentation 118. The downwardly extending arm 117 can be inserted into slot 116 of the base 114 and above the respective post 115. The indentation 118 can be aligned with the post 115 and moved inwardly and downwardly until the downwardly extending arm 117 of the rail hook 113 securely engages the post 115. In some embodiment, the base 114 can be attached to the feed assembly 120 in a way that the feed assembly 120 can be positioned on the axis of symmetry of the main reflector 110.

In one preferred embodiment, as shown in FIG. 2, the main reflector 110 includes six petals 112, formed from metal-plated plastic sheet with their adjoining edges arranged in close contact relation, and attached to the base so that they can be separated from it and stacked atop each other in a carrying case in the stowed position.

In some embodiments, as shown in FIG. 3, the petals 112 may include one or more tabs 200 extending from the petal edge surface and arranged to engage a recessed area 210 provided on the adjoining petal edge surface to accommodate the tab 200. The tabs 200 may connect the edges of the petals 112 together and limit the lateral and vertical movement of the petals 112 that are attached to the base 114.

The feed assembly 120 receives the electromagnetic wave from a transmitter (not depicted) to distribute the electromagnetic wave to the present invention. As the main reflector 110 and the subreflector 122 provide signal communication over transmission or reception frequency bands, the feed assembly 120 associated with the main reflector 110 and the subreflector 122 supports transmission or reception of radio frequency signals over the selected frequency bands.

Figure 4:
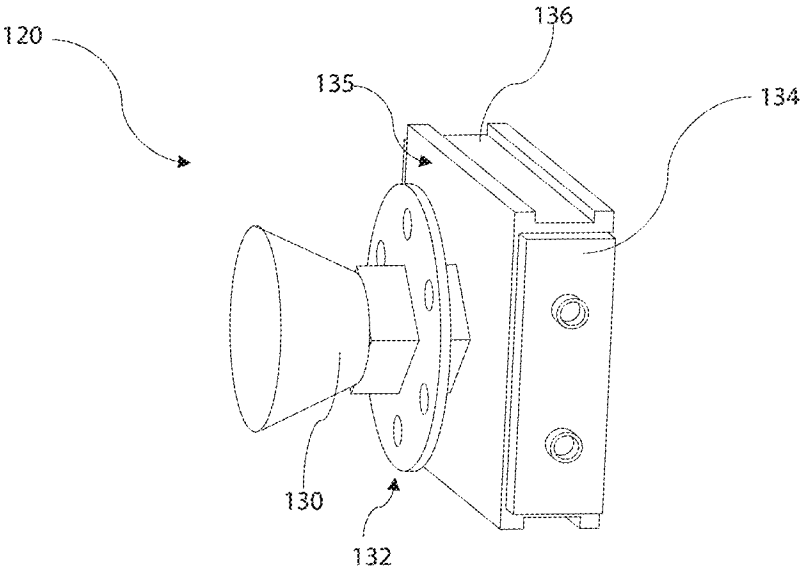
FIG. 4 is an illustration of one embodiment of the feed assembly of present invention.

The feed assembly 120, as shown in FIG. 4, can be a single unit coupled to the main reflector 110 and provided between the main reflector 110 and the subreflector 122, as shown in FIG. 1.

The feed assembly 120 may include a horn 130, a wideband junction 132, a hybrid coupler 134, a holder 135, where the horn 130 can be configured to cover more than octave bandwidth (14-31 GHz). The subreflector 122 may be configured by an axially displaced ellipse (ADE) shape. In one embodiment, the subreflector 122 can be integrated with a protective radome cover 124 that directly attaches to the horn 130. The subreflector 122 may have a lateral cross-section of a larger than a corresponding lateral cross-section of the horn 130 that attaches to the wideband junction 132, as shown in FIG. 5.

Figure 5:
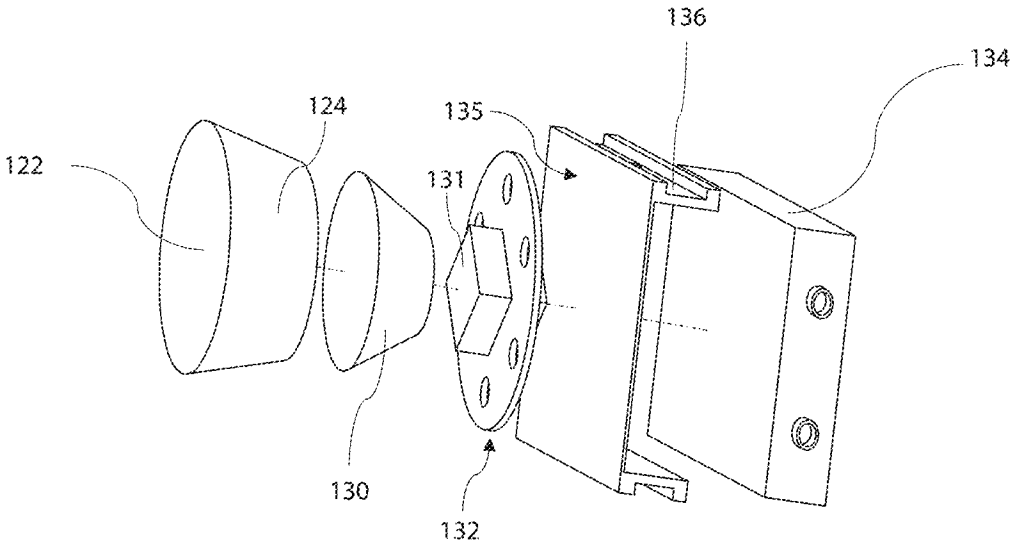
FIG. 5 is a depiction of an exploded view showing the subreflector, protective radome cover, and feed assembly of the present invention.

The feed assembly 120 may include a structural transition at a connecting point 131 between the horn 130, which is circular; the wideband junction 132 that can be rectangular at the connecting point 131, as shown in FIG. 5. In one embodiment, the wideband junction 132 may be attached to the hybrid coupler 134 by the holder 135 which includes fixed rails 136.

Figure 6:
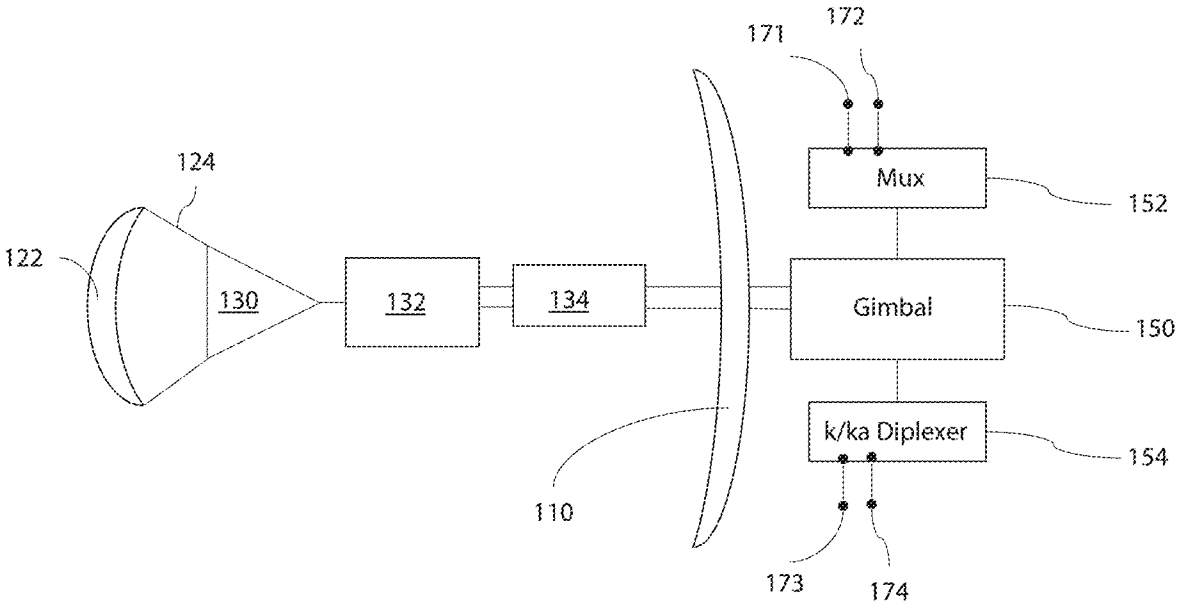
FIG. 6 is a block diagram showing the connection of the subreflector, protective radome cover, feed assembly, and gimbal of the present invention.

FIG. 6 shows a functional block diagram of the physical embodiment depicted in FIG. 5 with the gimbal 150. The illustrative diagram includes a horn 130 connected to the wideband junction 132 coupled with a hybrid coupler 134 which can be attached to the main reflector 110, which is secured to the gimbal 150.

The present invention may further include at least one multiplexer (mux) 152 and at least one k/ka diplexer 154 for separating and isolating frequency bands.

The main reflector 110 connected to the hybrid coupler 134 can be connected to the gimbal 150 which may be configured to transport signals from the main reflector 110 to the mux 152 for a Ku band receive 171 and a Ku band transmit 172 and the k/ka diplexer 154 for a K band 173 and a Ka band 174.

In one embodiment, the main reflector 110 and the gimbal 150 may be connected by RF cables and the gimbal 150 can be directly connected to the mux 152 and the k/ka diplexer 154 by a printed circuit board or by RF cables.

In other embodiment, the main reflector 110 can be directly connected to at least one mux 152 and at least one k/ka diplexer 154 by a printed circuit board or by RF cables.

In yet other embodiment, the hybrid coupler 134 can be directly connected to at least one mux 152 and one or more k/ka diplexers 154 by a printed circuit board or by RF cables.

The Ku band receive (Rx) (14.4-14.83 GHz) 171 and the Ku band transmit (Tx) (15.15-15.35 GHz) 172 are right hand circular polarized (RHCP), and the K band (20.2-21.2 GHz) 173 and Ka band (30-31 GHz) 174 are either left hand circular polarized (LHCP) or right hand circular polarized (RHCP).

The hybrid coupler 134 can be an off the shelf coaxial hybrid coupler that provides a circular polarization. The horn 130 can be a multi-flare horn for wide band performance. For example, the horn 130 may be a smooth-walled wideband multi-flare horn which employs a ridged waveguide input interface for wideband matching.

The horn 130 can be connected to the protective radome cover 124 which is attached to the subreflector 122, as shown in FIG. 6.

The wideband junction 132 can be a wideband coaxial feed junction configured to allow a linearly polarized (LP) signal conversion to a circularly polarized (CP) signal. The mux 152 can be placed any suitable area on the present invention and can be a four-band mux or a two-band diplexer to separate the Ku band receive 171 and Ku band transmit 172 signals to an electronic device connected to the present invention. The k/ka diplexer 154 can be placed any suitable area on the present invention and can be a two-port diplexer to separate the K band 173 and Ka band 174 signals to an electronic device connected to the present invention.

Figure 7:
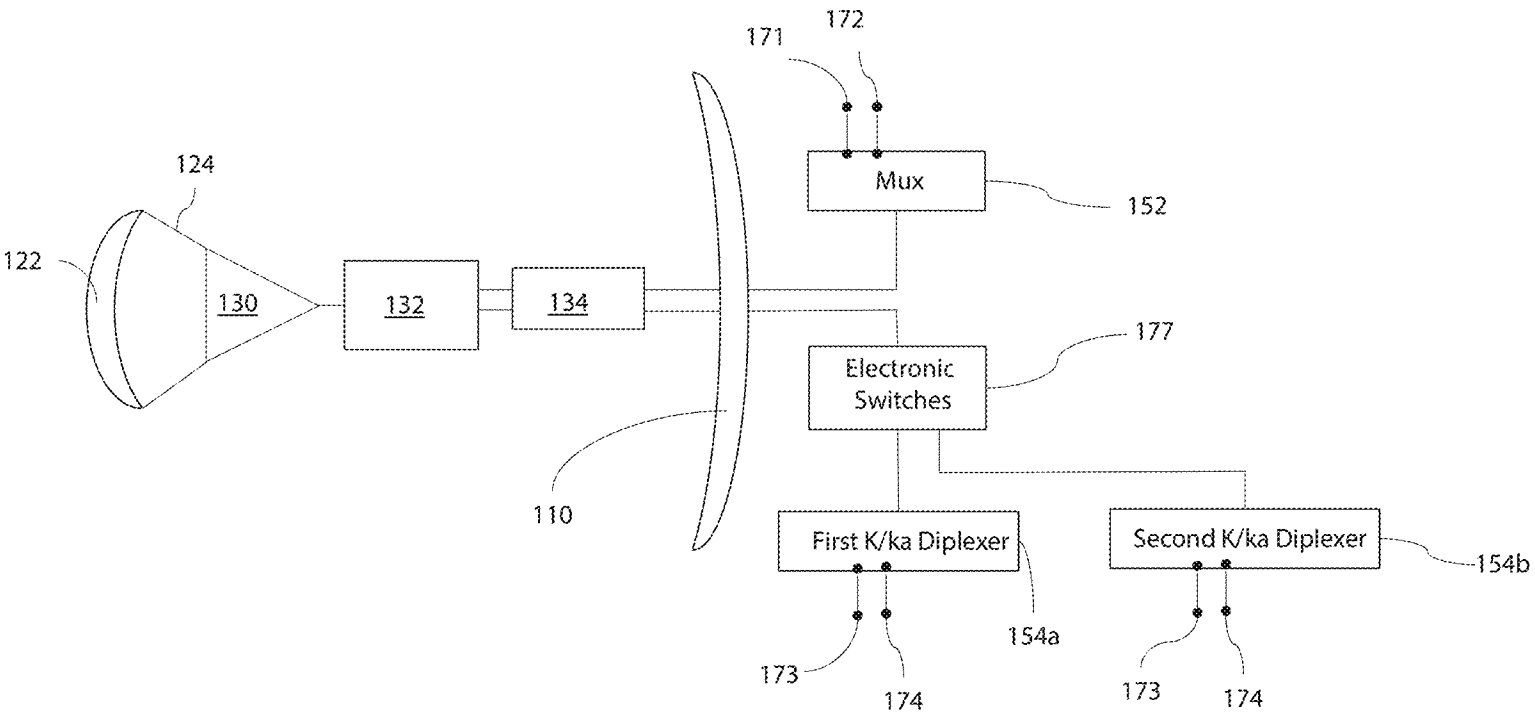
FIG. 7 is a block diagram showing the connection of the subreflector, protective radome cover, feed assembly, and the electronic switch of the present invention.

In some embodiments, as shown in FIG. 7, the present invention may include the mux 152, a first k/ka diplexer **154*a* and a second k/ka diplexer 154*b*. In such embodiments, the mux 152 is a two-band diplexer configured to separate Ku band receive 171 and Ku band transmit 172 signals from each other; the Ku band receive 171 and Ku band transmit 172 signals are right hand circular polarized (RHCP). The first k/ka diplexer 154*a* is configured to separate K band 173 and Ka band 174 signals from each other; the K band 173 and Ka band 174** signals are left hand circular polarized (LHCP).

The second k/ka diplexer **154*b* is configured to separate K band 173 and Ka band 174 signals from each other; the K band 173 and Ka band 174 signals are right hand circular polarized (RHCP). In these embodiments, the first k/ka diplexer 154*a* and the second k/ka diplexer 154*b* can be connected with multiple electronic switches 177 configured to provide switchable polarization signals between RHCP and LHCP at both K band 173 and Ka band 174. The electronic switches 177 and the mux 152 can be directly connected to the hybrid coupler 134. In some embodiments, the electronic switches 177 and the mux 152 can be connected to the main reflector 110. The electronic switches 177 and the mux 152** can be placed any suitable area on the present invention.

Conventional antenna design may require four phased array antennas to support four independent frequencies. However, the conventional antenna design has many drawbacks including size, cost, mass and high power dissipation. Thus, the conventional antennas are not suitable for man-pack applications.

Figure 8:
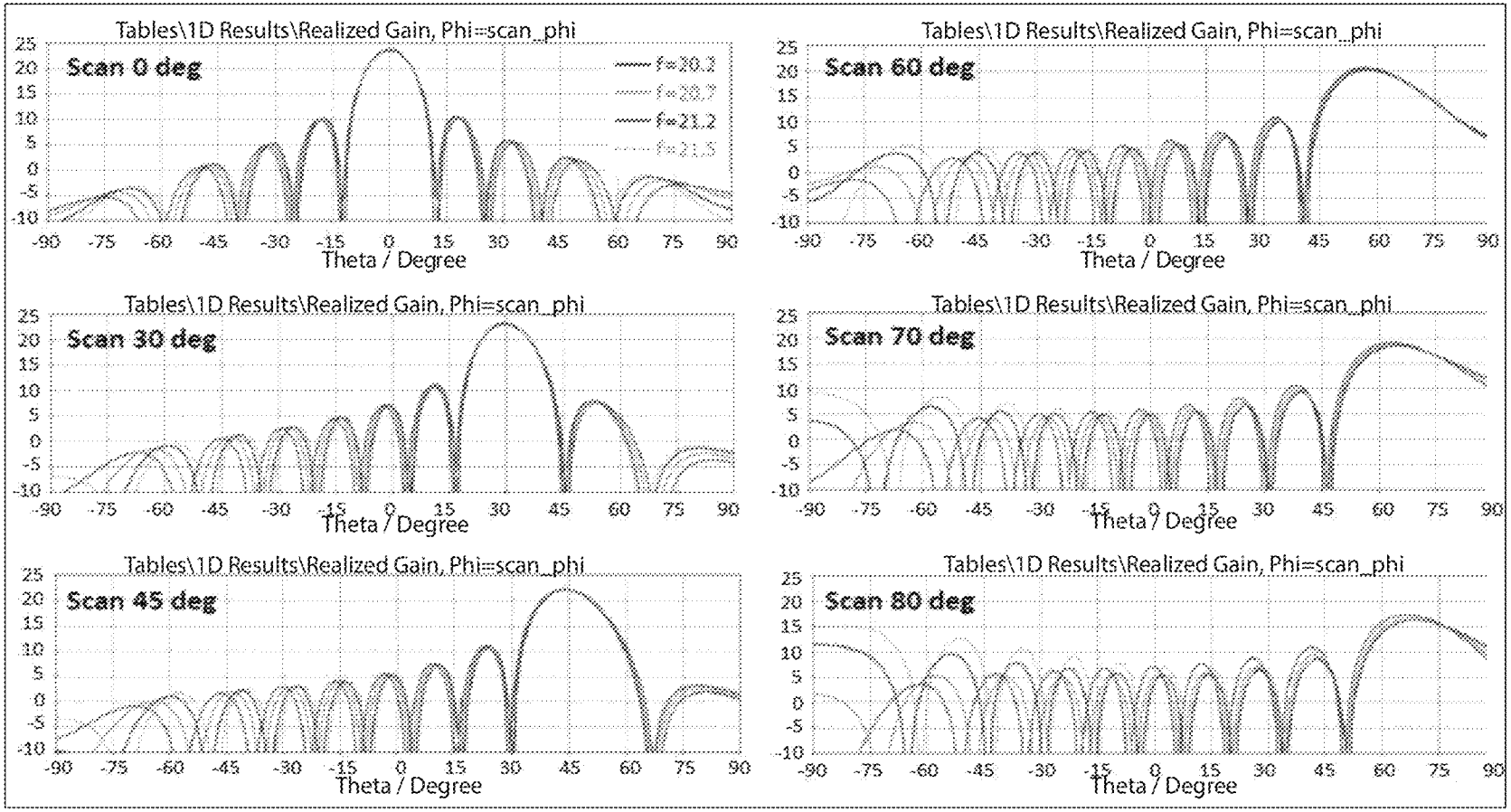
FIG. 8 is a diagram illustrating patterns of Phased Array (PA) antenna at different scan angles illustrating scan loss of about 6 dB (worst-case) over the coverage of +/−70 degrees.

FIG. 8 shows patterns of Phased Array (PA) antenna at different scan angles illustrating scan loss of about 6 dB (worst-case) over the coverage of +/−70 degrees. The present invention disclosed here in does not have this huge scan loss and hence the present invention gives a better gain performance.

FIG. 9 shows a comparison between the conventional PA antenna and the present invention. As shown in this figure, the present invention has advantages of better performance, low mass, low cost & low dissipation.

Figure 10:
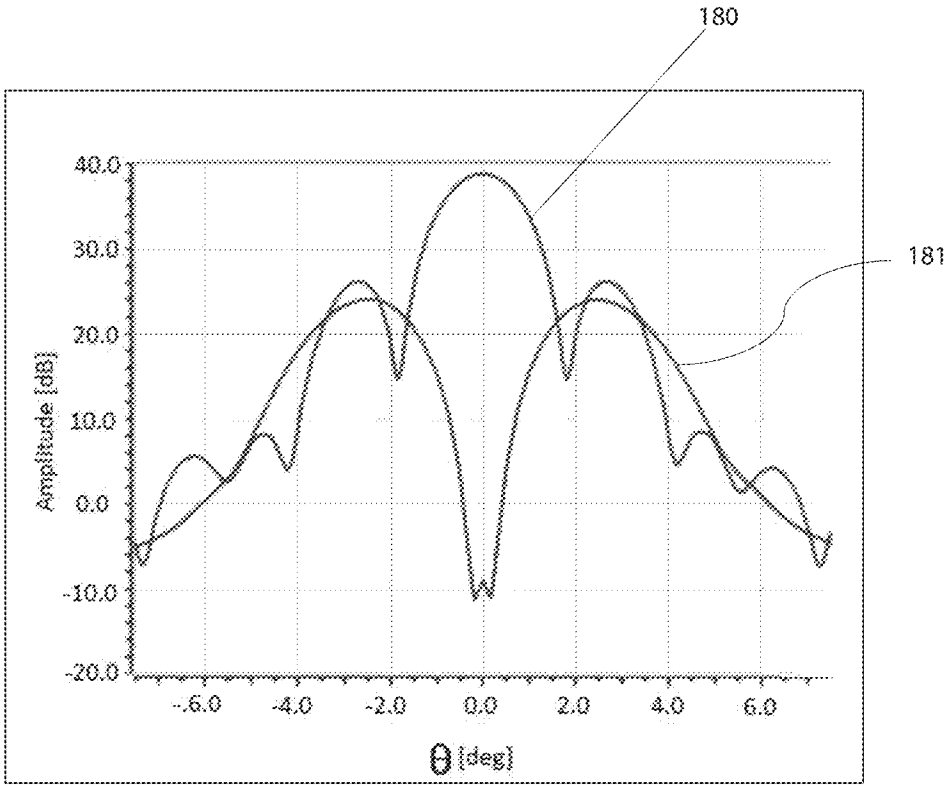
FIG. 10 is a diagram illustrating plots of radiation patterns of the present invention with a co-polar at Ka-band frequencies and a cross-pol at Ka-band frequencies showing high gain and low cross-polar radiation.

FIG. 10 shows plots of radiation patterns of the present invention with a co-polar at Ka-band frequencies 180 and a cross-pol at Ka-band frequencies 181 showing high gain and low cross-polar radiation.

Figure 11:
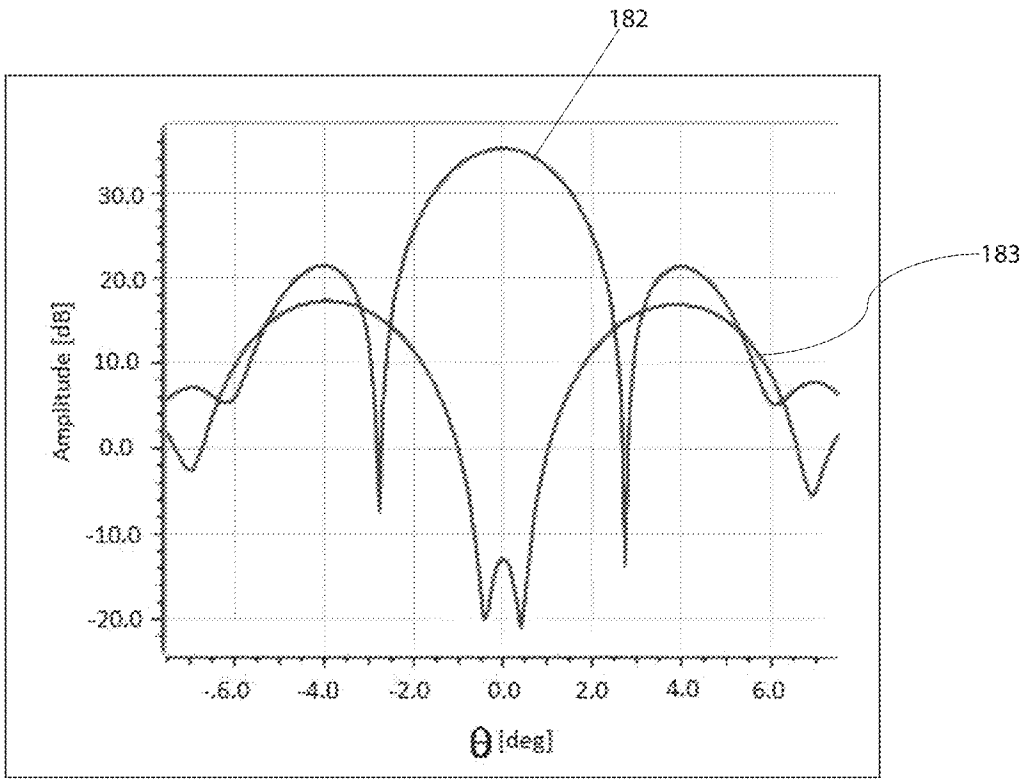
FIG. 11 is a diagram illustrating plots of radiation patterns of the present invention with a co-polar at K-band frequencies and a cross-pol at K-band frequencies showing high gain and low cross-polar radiation.

FIG. 11 shows plots of radiation patterns of the present invention with a co-polar at K-band frequencies 182 and a cross-pol at K-band frequencies 183 showing high gain and low cross-polar radiation.

Figure 12:
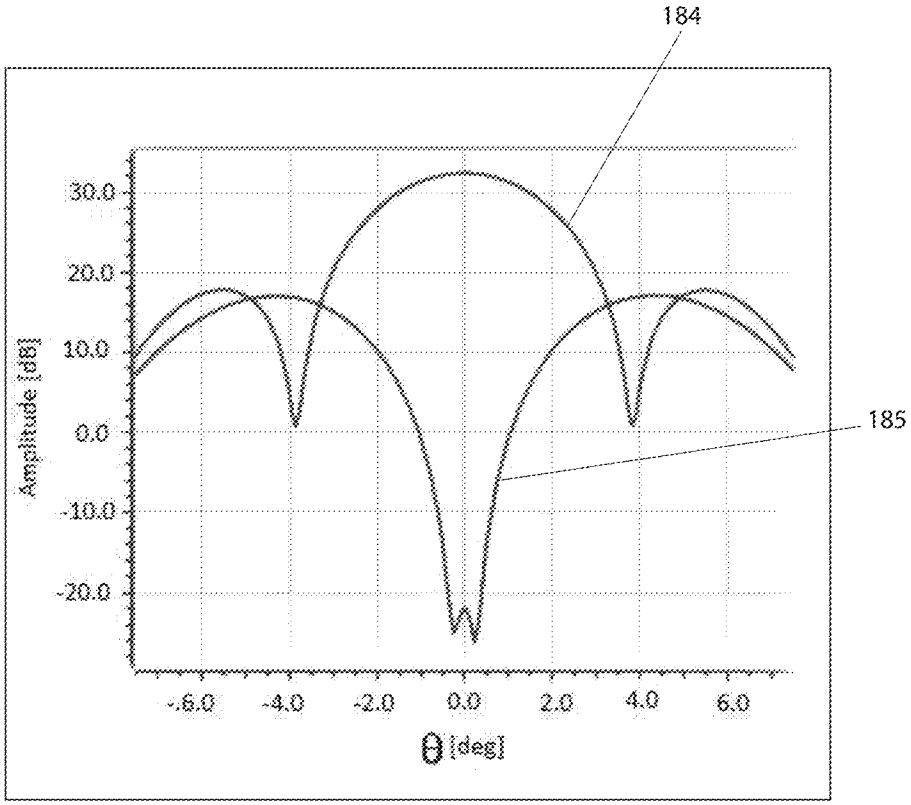
FIG. 12 is a diagram illustrating plots of radiation patterns of the present invention with a co-polar at Ku-band transmit frequencies and a cross-pol at Ku-band transmit frequencies showing high gain and low cross-polar radiation.

FIG. 12 shows plots of radiation patterns of the present invention with a co-polar at Ku-band transmit frequencies 184 and a cross-pol at Ku-band transmit frequencies 185 showing high gain and low cross-polar radiation.

Figure 13:
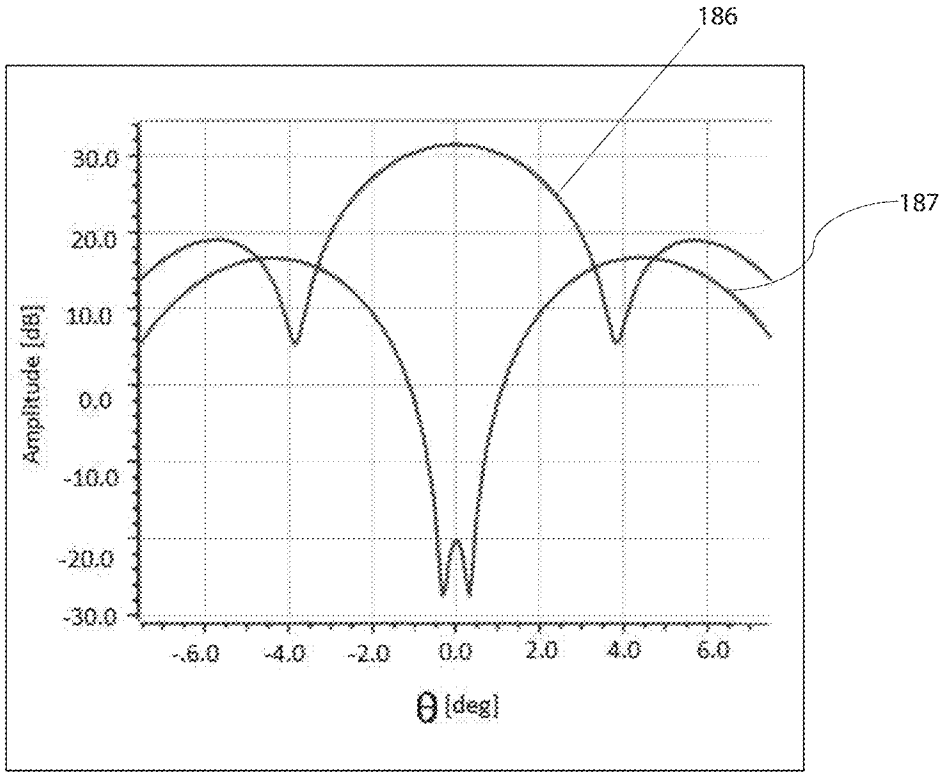
FIG. 13 is a diagram illustrating plots of radiation patterns of the present invention with a co-polar at Ku-band receive frequencies and a cross-pol at Ku-band receive frequencies showing high gain and low cross-polar radiation.

FIG. 13 shows plots of radiation patterns of the present invention with a co-polar at Ku-band receive frequencies 186 and a cross-pol at Ku-band receive frequencies 187 showing high gain and low cross-polar radiation.

FIG. 14 shows a deployed antenna configuration and detailed gain/loss budgets of the present invention where losses from various components are given.

The support station member 140 of the present invention may include a support structure that can be quickly and conveniently set up over a desired ground point. By positioning the support station member 140 upon the desired ground location, the present invention may be quickly and accurately positioned through the 2-axis gimbal mechanism.

In one embodiment, the support station member 140 may include a platform 143 hingedly connected to a plurality of adjustable support legs 141 and a monopod 142, as shown in FIG. 1. The monopod 142 can be attached to the center of the platform 143 so that the monopod 142 can be laterally moved about.

In some embodiment, as shown in FIG. 1, the gimbal 150 can be connected to the platform 143 by a rod 144 and rotatably coupled to the main reflector 110. The gimbal 150 can be any type of gimbal, either electric or hydraulic, that rotatably couples one structure to another structure. In some embodiments, the support station member 140 can be attached to RF cables and the support station member 140 can be a lightweight graphite tripod that includes elevation and azimuth features.

The gimbal 150 may be used to enable pointing of the petal reflector antenna 100 of the present invention to Earth in azimuth and elevation.

In some embodiments, the platform 143 may include Az/El rotary joints or RF cables: for example, two service loop cables for elevation and two service loop cables for azimuth.

Figure 15:
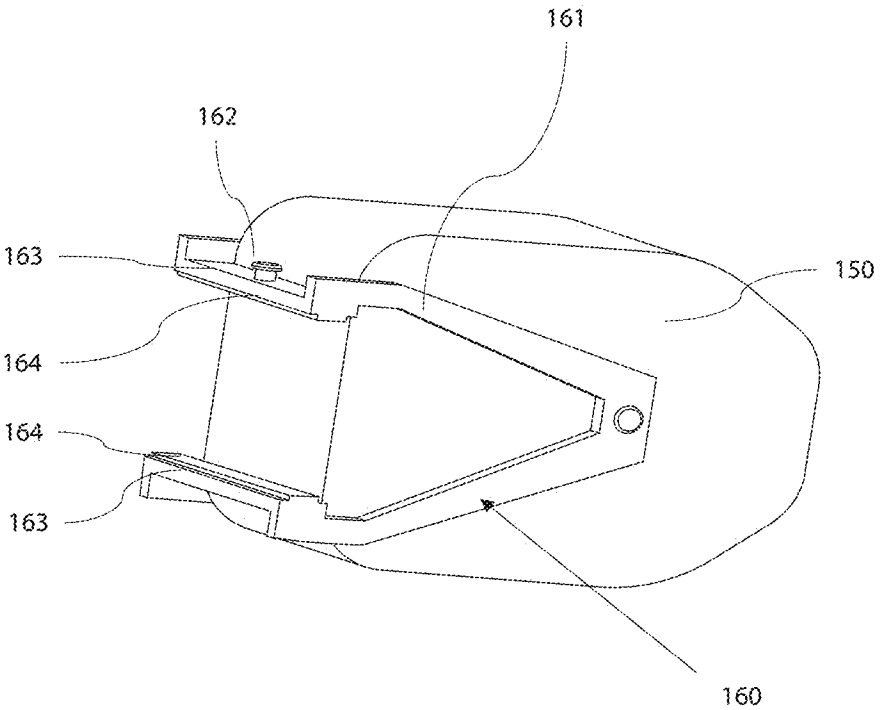
FIG. 15 is an illustration showing one embodiment of the mounting bracket connected to the gimbal of the present invention.

In some embodiments, as shown in FIG. 15, the present invention may include a mounting bracket 160 to connect the feed assembly 120 to the gimbal 150. The mounting bracket 160 may include connecting arms 161, a stopper 162, panels 163 with protruding members 164 sized to fit in the fixed rails 136 shown in FIG. 5 to enable the mounting bracket 160 to be slidable on the fixed rails 136.

Figure 16:
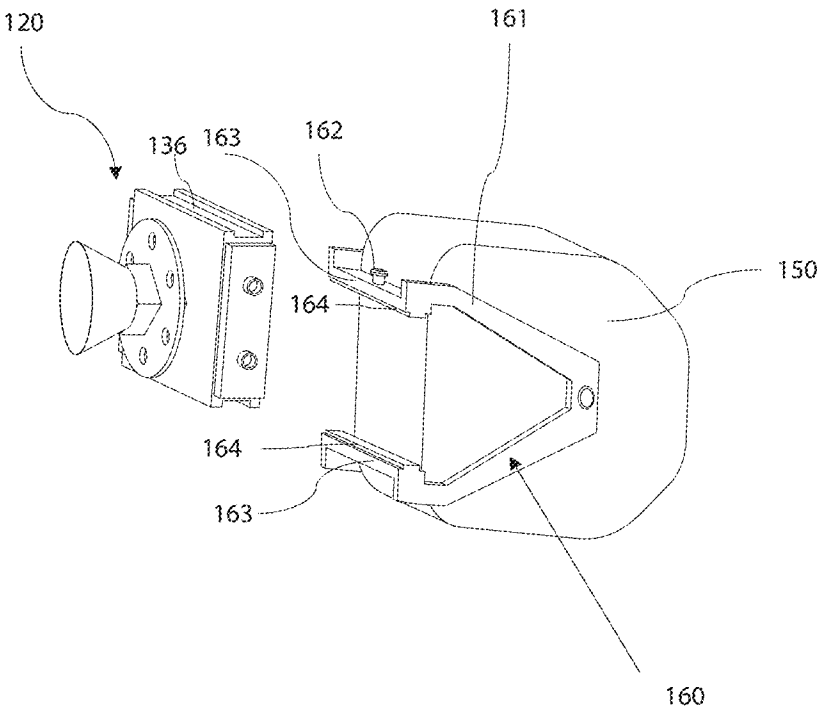
FIG. 16 is an illustration showing how the feed assembly can be attached to the gimbal of the present invention.

As shown in FIG. 16, the connecting arms 161 may connect the mounting bracket 160 to the gimbal 150. The feed assembly 120 can be installed on the mounting bracket 160 by sliding the protruding members 164 on the fixed rails 136. The stopper 162 can be a screw or rivet or retractable spring plunger or any other device mounted on the panels 163 to limit travel or horizontal movement of the feed assembly 120 installed in the mounting bracket 160.

Although the invention has been explained in relation to its preferred embodiment, it is to be understood that many other possible modifications and variations can be made without departing from the spirit and scope of the invention.

What is claimed is:

1. A petal reflector antenna comprising:

a main reflector having a paraboloid shape and a plurality of identical petals; the main reflector configured to simultaneously receive and transmit radio frequency signals at least four different frequencies;

a k/ka diplexer;

a multiplexer;

a feed assembly positioned on the axis of symmetry of the main reflector, feed assembly including:

a horn;

a wideband junction attached to the horn;

a holder coupled to the wideband junction; and a hybrid coupler mounted to the holder, the hybrid coupler connected to the k/ka diplexer and the multiplexer;

a protective radome cover attached to the horn;

a subreflector having a lateral cross-section of a larger dimension than a corresponding lateral cross-section of the horn, where in the subreflector mates with the protective radome cover; and a support station member coupled to the feed assembly.

2. The petal reflector antenna as claimed in claim 1, wherein the main reflector includes six identical petals.

3. The petal reflector antenna as claimed in claim 1, wherein the horn supports at least four different bands.

4. The petal reflector antenna as claimed in claim 1, wherein the hybrid coupler includes a LHCP port coupled to the k/ka diplexer and a RHCP port coupled to the multiplexer.

5. The petal reflector antenna as claimed in claim 1, wherein the k/ka diplexer is configured to separate K and Ka signals from each other.

6. The petal reflector antenna as claimed in claim 1, wherein the multiplexer is configured to separate Ku band receive and Ku band transmit signals from each other.

7. The petal reflector antenna as claimed in claim 1, wherein the wideband junction is a rectangular wide band junction.

8. The petal reflector antenna as claimed in claim 1, wherein subreflector is of an axially displaced ellipse shape.

9. The petal reflector antenna as claimed in claim 1, wherein the support station member comprises a platform hingedly connected to a plurality of adjustable support legs and a monopod.

10. The petal reflector antenna as claimed in claim 9, wherein the platform is coupled to a gimbal that includes elevation and azimuth features.

11. The petal reflector antenna as claimed in claim 10, wherein the gimbal is coupled to the holder by a mounting bracket, wherein the gimbal is connected to the k/ka diplexer and the mutiplexer.

12. The petal reflector antenna as claimed in claim 11, wherein the mounting bracket includes a stopper and protruding members sized to fit in the fixed rails.

13. The petal reflector antenna as claimed in claim 1, wherein the support station member is a lightweight graphite tripod that includes elevation and azimuth features and RF cables.

14. The petal reflector antenna as claimed in claim 11, wherein the holder includes fixed rails.

15. A petal reflector antenna comprising:

a main reflector having a paraboloid shape and six identical petals; the main reflector configured to simultaneously receive and transmit four different radio frequency signals;

a two-band diplexer configured to separate Ku band receive and Ku band transmit signals from each other; the Ku band receive and Ku band transmit signals are right hand circular polarized (RHCP);

a first k/ka diplexer configured to separate K and Ka signals from each other; the K and Ka signals are left hand circular polarized (LHCP);

a second k/ka diplexer configured to separate K and Ka signals from each other; the K and Ka signals are right hand circular polarized (RHCP);

a feed assembly positioned on the axis of symmetry of the main reflector, feed assembly including:

a horn;

a wideband junction attached to the horn separating Ku band from K/Ka bands;

a holder coupled to the wideband junction; and a hybrid coupler mounted to the holder, the hybrid coupler connected to the two-band diplexer, the first k/ka diplexer and the second k/ka diplexer;

a protective radome cover attached to the horn;

a subreflector having a lateral cross-section of a larger dimension than a corresponding lateral cross-section of the horn, where in the subreflector mates with the protective radome cover; and a support station member coupled to the feed assembly.

16. The petal reflector antenna as claimed in claim 15, wherein the first k/ka diplexer and the second k/ka diplexer are connected with two electronic switches configured to provide switchable polarization signals between RHCP and LHCP at both K band and Ka band.

* * * * *